US011746688B1

(12) United States Patent
Borla

(10) Patent No.: US 11,746,688 B1
(45) Date of Patent: Sep. 5, 2023

(54) CROSS-PIPE EXHAUST ASSEMBLY

(71) Applicant: David Akiba Borla, Thousand Oaks, CA (US)

(72) Inventor: David Akiba Borla, Thousand Oaks, CA (US)

( * ) Notice: Subject to any disclaimer, the term of this patent is extended or adjusted under 35 U.S.C. 154(b) by 0 days.

(21) Appl. No.: 17/662,626

(22) Filed: May 9, 2022

Related U.S. Application Data

(63) Continuation-in-part of application No. 16/666,277, filed on Oct. 28, 2019, now Pat. No. 11,326,501.

(60) Provisional application No. 62/751,590, filed on Oct. 27, 2018.

(51) Int. Cl.
*F01N 13/10* (2010.01)
*F01N 13/18* (2010.01)

(52) U.S. Cl.
CPC ..... *F01N 13/10* (2013.01); *F01N 13/1805* (2013.01); *F01N 2470/14* (2013.01); *F01N 2470/16* (2013.01)

(58) Field of Classification Search
CPC .. F01N 13/08; F01N 13/1805; F01N 2470/14; F01N 2470/16
See application file for complete search history.

(56) References Cited

U.S. PATENT DOCUMENTS 1,351,122 A 8/1920 Paulson
1,591,088 A 7/1926 Holmes
1,740,805 A 12/1929 Brice
1,903,803 A 4/1933 Barker
2,019,697 A 11/1935 Smith
2,075,316 A 3/1937 Tyden
2,896,739 A 7/1959 Kuras
2,995,200 A 8/1961 Seifert
2,996,139 A 8/1961 Patterson
3,139,153 A 6/1964 De Remer
3,447,630 A 6/1969 Davidson
3,470,690 A 10/1969 Thompson
3,507,301 A 4/1970 Larson
3,572,463 A 3/1971 Eschenburg
3,612,212 A 10/1971 Macdonald
3,630,311 A 12/1971 Nagamatsu
3,948,349 A 4/1976 Bychinsky
4,036,452 A 7/1977 Schairer
4,342,195 A 8/1982 Lo
4,605,092 A 8/1986 Harris et al.
4,621,494 A 11/1986 Fujita
4,712,644 A 12/1987 Sun
4,800,719 A 1/1989 Campbell
(Continued)

*Primary Examiner* — Anthony Ayala Delgado
(74) *Attorney, Agent, or Firm* — Robinson IP Law, PLLC

(57) ABSTRACT

A cross-pipe exhaust assembly includes: a first inlet collector splitting into an upper outlet and a lower outlet; a second inlet collector splitting into an upper outlet and a lower outlet; a first outlet collector joining an upper inlet and a lower inlet into a single outlet; a second outlet collector joining an upper inlet and a lower inlet into a single outlet; a first inline conduit located between the first inlet collector and the first outlet collector; a second inline conduit located between the second inlet collector and the second outlet collector; a first crossover conduit between the lower outlet or upper outlet of the first inlet collector and the upper inlet or lower inlet; and a second crossover conduit extending between the lower outlet or the upper outlet and the upper inlet or lower inlet of the first outlet collector.

12 Claims, 7 Drawing Sheets

(56) References Cited

U.S. PATENT DOCUMENTS

| | | | | |
|---|---|---|---|---|
| 4,926,634 | A * | 5/1990 | Putz | F01N 13/011 60/299 |
| 4,953,352 | A | 9/1990 | Campbell | |
| 5,018,349 | A | 5/1991 | Pemberton | |
| 5,033,581 | A | 7/1991 | Feuling | |
| 5,144,799 | A | 9/1992 | Barth | |
| 5,198,625 | A | 3/1993 | Borla | |
| 5,214,253 | A | 5/1993 | Houston, Jr. | |
| 5,216,883 | A | 6/1993 | Flugger | |
| 5,727,386 | A | 3/1998 | Watanabe et al. | |
| 5,740,671 | A | 4/1998 | Jones | |
| 6,247,305 | B1 | 6/2001 | Bassani | |
| 6,273,772 | B1 | 8/2001 | Smullin | |
| 6,478,340 | B1 | 11/2002 | Butler | |
| 6,662,900 | B2 | 12/2003 | Cathcart et al. | |
| 7,380,635 | B2 | 6/2008 | Harris | |
| 7,426,980 | B2 | 9/2008 | Bassani | |
| 7,596,944 | B2 | 10/2009 | Mueller et al. | |
| 7,610,748 | B2 | 11/2009 | Kono et al. | |
| 7,856,815 | B2 | 12/2010 | Demura et al. | |
| 7,866,709 | B2 | 1/2011 | Spieth et al. | |
| 8,042,649 | B2 | 10/2011 | Inoue | |
| 8,181,732 | B1 | 5/2012 | Butler | |
| 8,196,703 | B2 | 6/2012 | Stanley | |
| 8,209,972 | B2 | 7/2012 | Tüch | |
| D664,906 | S | 8/2012 | Lucas | |
| 8,439,159 | B1 | 5/2013 | Borla | |
| 8,474,252 | B2 | 7/2013 | Butler | |
| D696,614 | S | 12/2013 | Lee et al. | |
| 8,826,651 | B2 | 9/2014 | Laube et al. | |
| 8,869,932 | B2 | 10/2014 | Butler et al. | |
| 9,284,868 | B2 | 3/2016 | Pommerer et al. | |
| 9,605,580 | B2 | 3/2017 | Drees et al. | |
| 9,638,087 | B2 | 5/2017 | Kim | |
| 9,945,280 | B2 | 4/2018 | Eichmueller et al. | |
| 10,753,264 | B2 | 8/2020 | Klemenc et al. | |
| 2007/0095056 | A1 | 5/2007 | Richter | |
| 2017/0362991 | A1 | 12/2017 | Schneider et al. | |
| 2018/0094757 | A1 | 4/2018 | Niaz | |

* cited by examiner

CROSS-PIPE EXHAUST ASSEMBLY

CROSS-REFERENCE TO RELATED APPLICATION(S)

This application claims priority to and is a continuation-in-part of U.S. patent application Ser. No. 16/666,277 for a "Cross-pipe Exhaust System" filed on Oct. 28, 2019, which claims priority to and is a non-provisional of U.S. Patent Application Ser. No. 62/751,590 filed on Oct. 27, 2018 for a "Cross-pipe Exhaust System," the contents of which are incorporated herein by reference in its entirety.

FIELD

This disclosure relates to the field of exhaust components for vehicles. More particularly, this disclosure relates to a cross-over pipe exhaust assembly for improving flow of exhaust gases.

BACKGROUND

Internal combustion engines generate hot waste gases that are typically expelled from an exhaust port of the engine. The hot waste gases through an exhaust system including one or more pipes that direct flow of exhaust gases through the exhaust system to an exhaust pipe where the gases leave the exhaust system.

Some exhaust systems include dual pipes with each pipe corresponding to a bank of cylinders of the engine. For example, in an engine wherein cylinders are arranged in a "V", exhaust gases are expelled from exhaust ports on opposing sides of the engine. The expelled gases travel through headers into a pair of exhaust pipes. Exhaust pipes typically include several bends along lengths of the exhaust pipes between exhaust ports of the engine and an exhaust pipe. These bends can create pressure within the exhaust pipes, thereby decreasing efficiency of the engine and may create unequal pressure across exhaust pipes corresponding to separate cylinder banks of the engine.

Some exhaust systems include crossover or x-pipes that allow exhaust gas pressure from two cylinder banks to equalize. Existing crossover pipes may in some cases reduce the efficiency of exhaust flow through the exhaust system or otherwise create undesirable an undesirable sound or note of the engine emitted from the exhaust pipes. What is needed, therefore, is a cross-pipe exhaust system that improves the flow of exhaust gases from an engine.

SUMMARY

In some aspects, the techniques described herein relate to an exhaust assembly for exhausting gas from an internal combustion engine, the exhaust assembly including: a first upstream conduit in fluid communication with a first bank of cylinders of an internal combustion engine; a second upstream conduit in fluid communication with a second bank of cylinders of the internal combustion engine; a first inlet collector connected to an end of the first upstream conduit, the first inlet collector having an inlet and splitting into first outlet and a second outlet, wherein the first outlet and the second outlet of the first inlet collector are aligned with the inlet; a second inlet collector connected to an end of the second upstream conduit, the second inlet collector splitting into a first outlet and a second outlet; a first outlet collector located downstream of the first inlet collector, the first outlet collector joining a first inlet and a second inlet into a single outlet of the first outlet collector; a second outlet collector located downstream of the second outlet collector, the second outlet collector joining a first inlet and a second inlet into a single outlet of the second outlet collector; a first conduit in fluid communication with one of the first outlet and the second outlet of the first inlet collector and one of the first inlet and the second inlet of the first outlet collector, the first conduit having at least one bend formed along a length of the first conduit; a second conduit in fluid communication with one of the first outlet and the second outlet of the second inlet collector and one of the first inlet and the second inlet of the second outlet collector, the second conduit having at least one bend formed along a length of the second conduit; a first crossover conduit in fluid communication one of the first outlet and the second outlet of the first inlet collector and one of the first inlet and the second inlet of the second outlet collector; and a second crossover conduit in fluid communication with one of the first outlet and the second outlet of the second inlet collector and one of the first inlet and the second inlet of the first outlet collector.

In some aspects, the techniques described herein relate to an exhaust assembly, wherein the at least one bend of the first conduit and the second conduit is U-shaped.

In some aspects, the techniques described herein relate to an exhaust assembly, further including one or more brackets located on one of the first conduit, the second conduit, the first crossover conduit, and the second crossover conduit for supporting the exhaust assembly on a vehicle.

In some aspects, the techniques described herein relate to an exhaust assembly, wherein: the first inlet collector and the second inlet collector are oriented such that the first outlet and the second outlet are oriented inward towards a center of a vehicle on which the exhaust assembly is installed; and the first outlet collector and the second outlet collector are oriented such that the outlet of the first outlet collector and the outlet of the second outlet collector are oriented outward away from the center of the vehicle on which the exhaust assembly is installed.

In some aspects, the techniques described herein relate to an exhaust assembly, further including: a bend located along a length of the first crossover pipe; a bend located along a length of the second crossover pipe conduit; wherein the bend located along the length of the second crossover pipe is located proximate to a point at which the first crossover pipe intersects with the second crossover pipe such that the first crossover pipe and the second crossover pipe are at least partially intertwined.

In some aspects, the techniques described herein relate to an exhaust assembly, wherein a diameter of the first inline conduit is greater than a diameter of the first crossover conduit and wherein a diameter of the second inline conduit is greater than a conduit of the second crossover conduit.

In some aspects, the techniques described herein relate to an exhaust assembly for exhausting gas from an internal combustion engine, the exhaust assembly including: a first upstream conduit in fluid communication with a first bank of cylinders of an internal combustion engine; a second upstream conduit in fluid communication with a second bank of cylinders of the internal combustion engine; a first inlet collector connected to an end of the first upstream conduit, the first inlet collector having an inlet and splitting into first outlet and a second outlet, wherein the first outlet and the second outlet of the first inlet collector are aligned with the inlet; a second inlet collector connected to an end of the second upstream conduit, the second inlet collector splitting into a first outlet and a second outlet; a first outlet collector located downstream of the first inlet collector, the first outlet collector joining a first inlet and a second inlet into a single outlet of the first outlet collector; a second outlet collector located downstream of the second outlet collector, the second outlet collector joining a first inlet and a second inlet into a single outlet of the second outlet collector; a first conduit in fluid communication with one of the first outlet and the second outlet of the first inlet collector and one of the first inlet and the second inlet of the first outlet collector; a second conduit in fluid communication with one of the first outlet and the second outlet of the second inlet collector and one of the first inlet and the second inlet of the second outlet collector; a first crossover conduit in fluid communication one of the first outlet and the second outlet of the first inlet collector and one of the first inlet and the second inlet of the second outlet collector, the first crossover conduit having at least one bend formed along a length of the first crossover conduit; and a second crossover conduit in fluid communication with one of the first outlet and the second outlet of the second inlet collector and one of the first inlet and the second inlet of the first outlet collector, the second crossover conduit having at least one bend formed along a length of the second crossover conduit; wherein the bend formed along a length of the first crossover conduit is proximate to the bend formed along the length of the second crossover conduit such that the first crossover conduit and the second crossover conduit are at least partially intertwined.

In some aspects, the techniques described herein relate to an exhaust assembly, further including: a bend located along a length of the first conduit; and a bend located along a length of the second conduit.

In some aspects, the techniques described herein relate to an exhaust assembly, wherein the bend located along the length of the first conduit and the bend located along the length of the second conduit are U-shaped.

In some aspects, the techniques described herein relate to an exhaust assembly, wherein: the first inlet collector and the second inlet collector are oriented such that the first outlet and the second outlet are oriented inward towards a center of a vehicle on which the exhaust assembly is installed; and the first outlet collector and the second outlet collector are oriented such that the outlet of the first outlet collector and the outlet of the second outlet collector are oriented outward away from the center of the vehicle on which the exhaust assembly is installed.

In some aspects, the techniques described herein relate to an exhaust assembly for exhausting gas from an internal combustion engine, the exhaust assembly including: a first upstream conduit in fluid communication with a first bank of cylinders of an internal combustion engine; a second upstream conduit in fluid communication with a second bank of cylinders of the internal combustion engine; a first inlet collector connected to an end of the first upstream conduit, the first inlet collector having an inlet and splitting into first outlet and a second outlet, wherein the first outlet and the second outlet of the first inlet collector are aligned with the inlet; a second inlet collector connected to an end of the second upstream conduit, the second inlet collector splitting into a first outlet and a second outlet; a first outlet collector located downstream of the first inlet collector, the first outlet collector joining a first inlet and a second inlet into a single outlet of the first outlet collector; a second outlet collector located downstream of the second outlet collector, the second outlet collector joining a first inlet and a second inlet into a single outlet of the second outlet collector; a first conduit in fluid communication with one of the first outlet and the second outlet of the first inlet collector and one of the first inlet and the second inlet of the first outlet collector, the first conduit including a U-shaped bend formed along a length thereof; a second conduit in fluid communication with one of the first outlet and the second outlet of the second inlet collector and one of the first inlet and the second inlet of the second outlet collector, the second conduit including a U-shaped bend formed along a length thereof; a first crossover conduit in fluid communication one of the first outlet and the second outlet of the first inlet collector and one of the first inlet and the second inlet of the second outlet collector, the first crossover conduit having at least one bend formed along a length of the first crossover conduit; and a second crossover conduit in fluid communication with one of the first outlet and the second outlet of the second inlet collector and one of the first inlet and the second inlet of the first outlet collector, the second crossover conduit having at least one bend formed along a length of the second crossover conduit; wherein the bend formed along a length of the first crossover conduit is proximate to the bend formed along the length of the second crossover conduit such that the first crossover conduit and the second crossover conduit are at least partially intertwined.

In some aspects, the techniques described herein relate to an exhaust assembly, wherein: the first inlet collector and the second inlet collector are oriented such that the first outlet and the second outlet are oriented inward towards a center of a vehicle on which the exhaust assembly is installed; and the first outlet collector and the second outlet collector are oriented such that the outlet of the first outlet collector and the outlet of the second outlet collector are oriented outward away from the center of the vehicle on which the exhaust assembly is installed. In some aspects, the techniques described herein relate to an exhaust assembly for exhausting gas from an internal combustion engine, the exhaust assembly including: a first upstream conduit in fluid communication with a first bank of cylinders of an internal combustion engine; a second upstream conduit in fluid communication with a second bank of cylinders of the internal combustion engine; a first inlet collector connected to an end of the first upstream conduit, the first inlet collector having an inlet and splitting into first outlet and a second outlet, wherein the first outlet and the second outlet of the first inlet collector are aligned with the inlet; a second inlet collector connected to an end of the second upstream conduit, the second inlet collector splitting into a first outlet and a second outlet; a first outlet collector located downstream of the first inlet collector, the first outlet collector joining a first inlet and a second inlet into a single outlet of the first outlet collector; a second outlet collector located downstream of the second outlet collector, the second outlet collector joining a first inlet and a second inlet into a single outlet of the second outlet collector; a first conduit in fluid communication with one of the first outlet and the second outlet of the first inlet collector and one of the first inlet and the second inlet of the first outlet collector, the first conduit having at least one bend formed along a length of the first conduit; a second conduit in fluid communication with one of the first outlet and the second outlet of the second inlet collector and one of the first inlet and the second inlet of the second outlet collector, the second conduit having at least one bend formed along a length of the second conduit; a first crossover conduit in fluid communication one of the first outlet and the second outlet of the first inlet collector and one of the first inlet and the second inlet of the second outlet collector; and a second crossover conduit in fluid communication with one of the first outlet and the second outlet of the second inlet collector and one of the first inlet and the second inlet of the first outlet collector. In some aspects, the techniques described herein relate to an exhaust assembly, wherein the at least one bend of the first conduit and the second conduit is U-shaped. In some aspects, the techniques described herein relate to an exhaust assembly, further including one or more brackets located on one of the first conduit, the second conduit, the first crossover conduit, and the second crossover conduit for supporting the exhaust assembly on a vehicle. In some aspects, the techniques described herein relate to an exhaust assembly, wherein: the first inlet collector and the second inlet collector are oriented such that the first outlet and the second outlet are oriented inward towards a center of a vehicle on which the exhaust assembly is installed; and the first outlet collector and the second outlet collector are oriented such that the outlet of the first outlet collector and the outlet of the second outlet collector are oriented outward away from the center of the vehicle on which the exhaust assembly is installed. In some aspects, the techniques described herein relate to an exhaust assembly, further including: a bend located along a length of the first crossover pipe; a bend located along a length of the second crossover pipe conduit; wherein the bend located along the length of the second crossover pipe is located proximate to a point at which the first crossover pipe intersects with the second crossover pipe such that the first crossover pipe and the second crossover pipe are at least partially intertwined. In some aspects, the techniques described herein relate to an exhaust assembly, wherein a diameter of the first inline conduit is greater than a diameter of the first crossover conduit and wherein a diameter of the second inline conduit is greater than a conduit of the second crossover conduit. In some aspects, the techniques described herein relate to an exhaust assembly for exhausting gas from an internal combustion engine, the exhaust assembly including: a first upstream conduit in fluid communication with a first bank of cylinders of an internal combustion engine; a second upstream conduit in fluid communication with a second bank of cylinders of the internal combustion engine; a first inlet collector connected to an end of the first upstream conduit, the first inlet collector having an inlet and splitting into first outlet and a second outlet, wherein the first outlet and the second outlet of the first inlet collector are aligned with the inlet; a second inlet collector connected to an end of the second upstream conduit, the second inlet collector splitting into a first outlet and a second outlet; a first outlet collector located downstream of the first inlet collector, the first outlet collector joining a first inlet and a second inlet into a single outlet of the first outlet collector; a second outlet collector located downstream of the second outlet collector, the second outlet collector joining a first inlet and a second inlet into a single outlet of the second outlet collector; a first conduit in fluid communication with one of the first outlet and the second outlet of the first inlet collector and one of the first inlet and the second inlet of the first outlet collector; a second conduit in fluid communication with one of the first outlet and the second outlet of the second inlet collector and one of the first inlet and the second inlet of the second outlet collector; a first crossover conduit in fluid communication one of the first outlet and the second outlet of the first inlet collector and one of the first inlet and the second inlet of the second outlet collector, the first crossover conduit having at least one bend formed along a length of the first crossover conduit; and a second crossover conduit in fluid communication with one of the first outlet and the second outlet of the second inlet collector and one of the first inlet and the second inlet of the first outlet collector, the second crossover conduit having at least one bend formed along a length of the second crossover conduit; wherein the bend formed along a length of the first crossover conduit is proximate to the bend formed along the length of the second crossover conduit such that the first crossover conduit and the second crossover conduit are at least partially intertwined. In some aspects, the techniques described herein relate to an exhaust assembly, further including: a bend located along a length of the first conduit; and a bend located along a length of the second conduit. In some aspects, the techniques described herein relate to an exhaust assembly, wherein the bend located along the length of the first conduit and the bend located along the length of the second conduit are U-shaped. In some aspects, the techniques described herein relate to an exhaust assembly, wherein: the first inlet collector and the second inlet collector are oriented such that the first outlet and the second outlet are oriented inward towards a center of a vehicle on which the exhaust assembly is installed; and the first outlet collector and the second outlet collector are oriented such that the outlet of the first outlet collector and the outlet of the second outlet collector are oriented outward away from the center of the vehicle on which the exhaust assembly is installed. In some aspects, the techniques described herein relate to an exhaust assembly for exhausting gas from an internal combustion engine, the exhaust assembly including: a first upstream conduit in fluid communication with a first bank of cylinders of an internal combustion engine; a second upstream conduit in fluid communication with a second bank of cylinders of the internal combustion engine; a first inlet collector connected to an end of the first upstream conduit, the first inlet collector having an inlet and splitting into first outlet and a second outlet, wherein the first outlet and the second outlet of the first inlet collector are aligned with the inlet; a second inlet collector connected to an end of the second upstream conduit, the second inlet collector splitting into a first outlet and a second outlet; a first outlet collector located downstream of the first inlet collector, the first outlet collector joining a first inlet and a second inlet into a single outlet of the first outlet collector; a second outlet collector located downstream of the second outlet collector, the second outlet collector joining a first inlet and a second inlet into a single outlet of the second outlet collector; a first conduit in fluid communication with one of the first outlet and the second outlet of the first inlet collector and one of the first inlet and the second inlet of the first outlet collector, the first conduit including a U-shaped bend formed along a length thereof; a second conduit in fluid communication with one of the first outlet and the second outlet of the second inlet collector and one of the first inlet and the second inlet of the second outlet collector, the second conduit including a U-shaped bend formed along a length thereof; a first crossover conduit in fluid communication one of the first outlet and the second outlet of the first inlet collector and one of the first inlet and the second inlet of the second outlet collector, the first crossover conduit having at least one bend formed along a length of the first crossover conduit; and a second crossover conduit in fluid communication with one of the first outlet and the second outlet of the second inlet collector and one of the first inlet and the second inlet of the first outlet collector, the second crossover conduit having at least one bend formed along a length of the second crossover conduit; wherein the bend formed along a length of the first crossover conduit is proximate to the bend formed along the length of the second crossover conduit such that the first crossover conduit and the second crossover conduit are at least partially intertwined. In some aspects, the techniques described herein relate to an exhaust assembly, wherein: the first inlet collector and the second inlet collector are oriented such that the first outlet and the second outlet are oriented inward towards a center of a vehicle on which the exhaust assembly is installed; and the first outlet collector and the second outlet collector are oriented such that the outlet of the first outlet collector and the outlet of the second outlet collector are oriented outward away from the center of the vehicle on which the exhaust assembly is installed.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
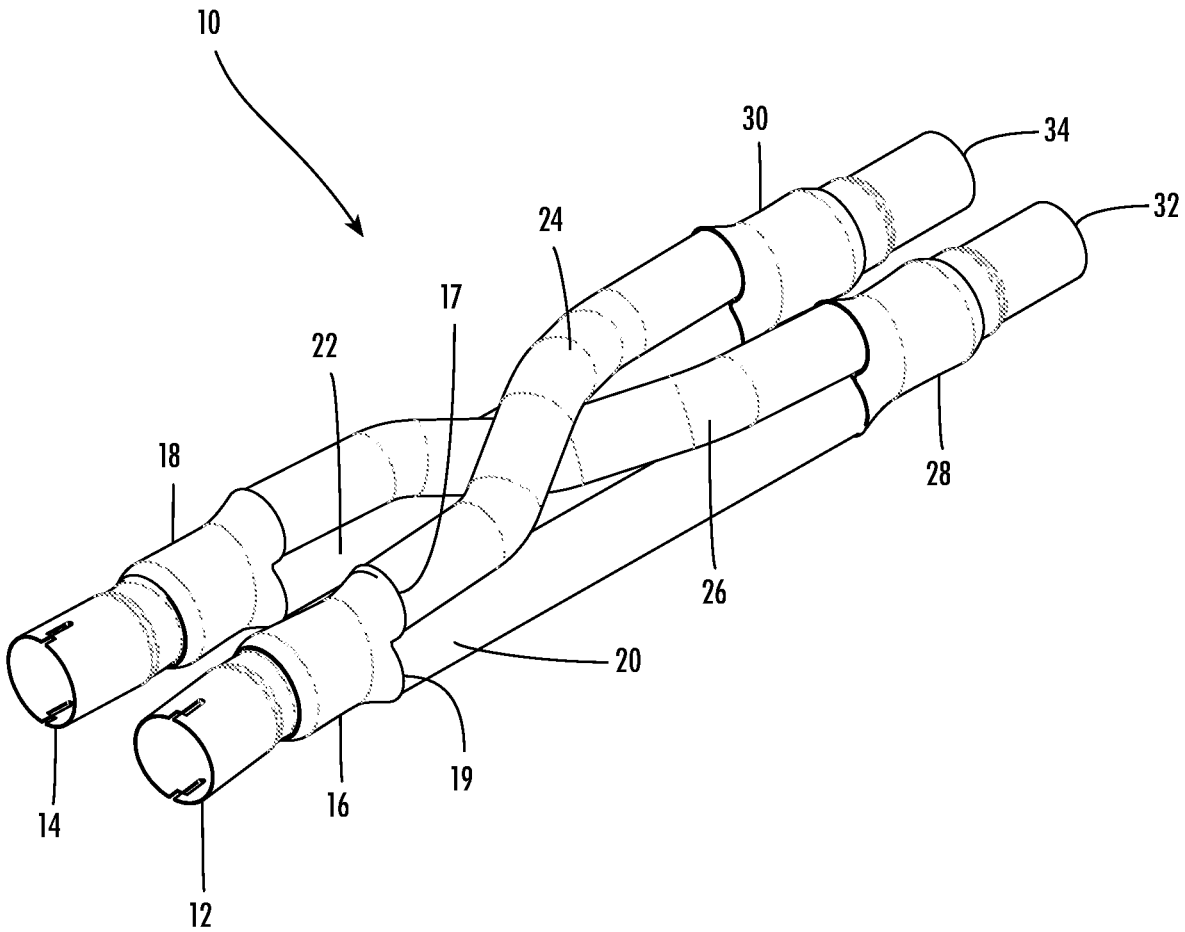
FIG. 1 shows a cross-pipe exhaust assembly according to one embodiment of the present disclosure.

FIG. 1 shows a basic embodiment of an exhaust assembly 10 including a plurality of pipes or conduits that are configured to allow exhaust pulses and gases from a first cylinder bank of an internal combustion engine to cross with exhaust pulses and gases from a second cylinder bank of the engine to increase efficiency of the engine and create a desirable engine sound through the exhaust. A portion of the exhaust gases are diverted to crossover while remaining exhaust gases continue to flow through the same pipe to an outlet of the exhaust. Embodiments of the exhaust assembly 10 described herein are preferably employed with internal combustion engines having at least a first bank of cylinders and a second bank of cylinders, wherein exhaust gases from each bank of cylinders are expelled into first and second headers and first and second pipes downstream from the headers. While the exhaust assembly 10 of the present disclosure is preferably employed with internal combustion engines having opposing banks of cylinders, it is also understood that embodiments of the present disclosure may be used with other various engines such that a flow of exhaust gases from a first pipe may be crossed with a flow of exhaust gases from a second pipe.

The exhaust assembly 10 includes a first inlet 12 and a second inlet 14 for receiving exhaust gases from the internal combustion engines. The first inlet 12 preferably receives exhaust gases from the first bank of cylinders and the second inlet 14 preferably receives exhaust gases from the second bank of cylinders. The first inlet 12 is in fluid communication with a first inlet collector 16 and the second inlet 14 is in fluid communication with a second inlet collector 18. The first inlet collector 16 and second inlet collector 18 are shaped to split an incoming exhaust flow from the first inlet 12 and the second inlet 14 respectively. The first inlet 12 and the second inlet 14 may be upstream from the exhaust assembly 10 such that exhaust gases pass through the first inlet 12 and the second inlet 14 into the exhaust assembly as described herein.

Each of the first inlet collector 16 and second inlet collector 18 split an incoming exhaust flow into two separate flows such that a portion of the exhaust flow crosses the exhaust assembly 10 and such that another portion of the exhaust flow continues at least partially along an existing path of the exhaust flow. The first inlet collector 16 and the second inlet collector 18 may split an incoming gas flow into a first outlet 17 and a second outlet 19. The first outlet 17 may be an upper outlet and the second outlet 19 may be a lower outlet as shown in FIG. 1. However, it is also understood that the first outlet 17 and the second outlet 19 may be otherwise arranged on the first inlet collector 16 and the second inlet collector 18. The first outlet 17 and the second outlet 19 of the first inlet collector 16 and the second inlet collector 18 may be at least partially aligned with an inlet of the first inlet 12 and the second inlet 14 to provide efficient flow of exhaust gases through the first inlet collector and the second inlet collector and into downstream conduits of the exhaust assembly 10 as described below.

Figure 3:
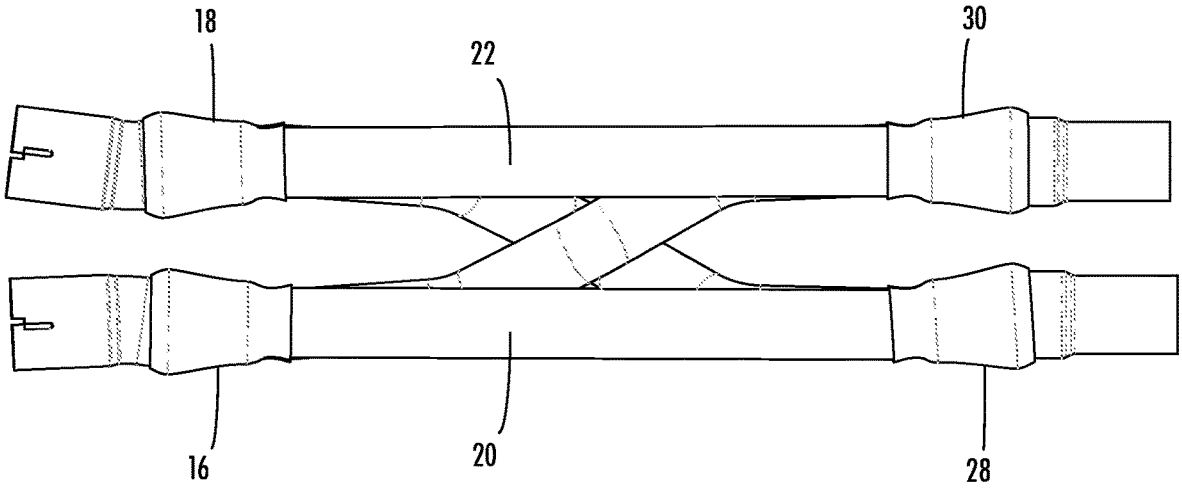
FIG. 3 shows a bottom view of a cross-pipe exhaust assembly according to one embodiment of the present disclosure.

The first inlet collector 16 is connected to and is in fluid communication with a first conduit 20 and the second inlet collector 18 is in fluid communication with a second conduit 22. The first conduit 20 and second conduit 22 are preferably elongate in shape having a circular cross-sectional area. The first conduit 20 and second conduit 22 extend from a first end to a second end that is distal from the first end. The first conduit 20 and second conduit 22 may be straight such and may be oriented such that the first conduit 20 is substantially parallel to the second conduit 22, as shown in FIG. 3.

Figure 2:
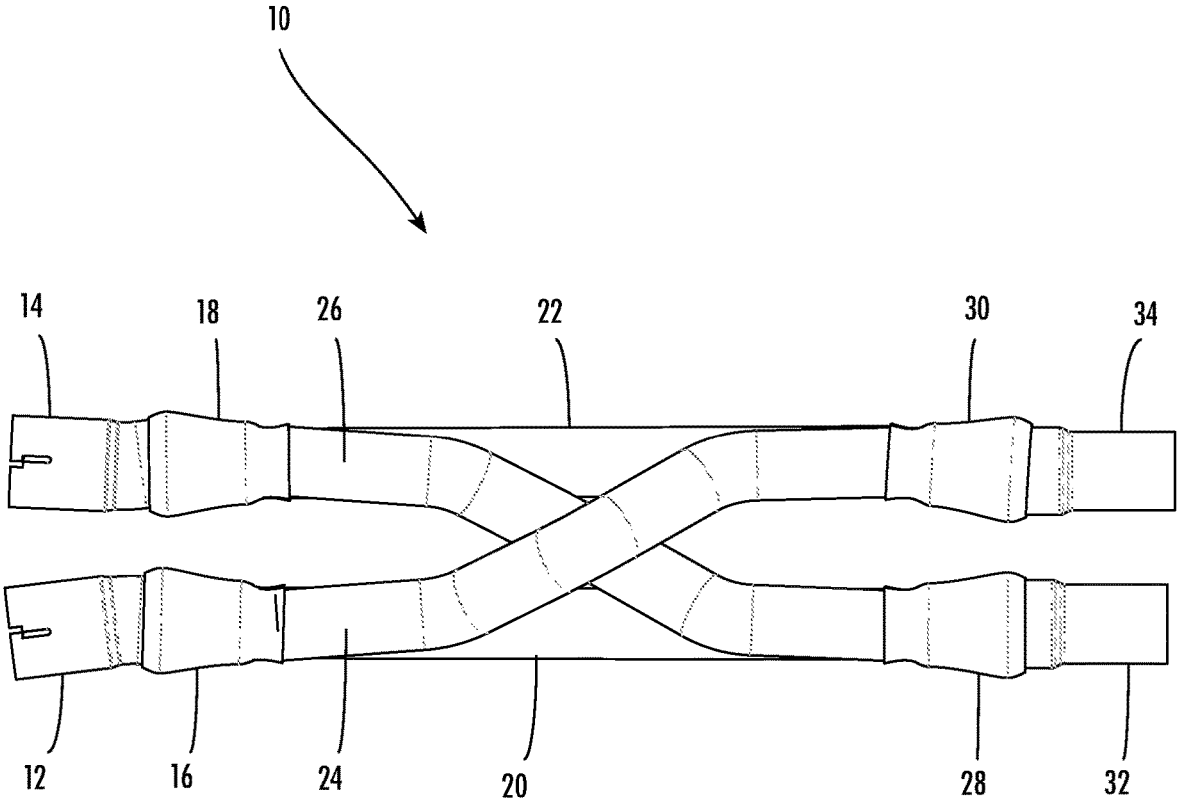
FIG. 2 shows a top view of a cross-pipe exhaust assembly according to one embodiment of the present disclosure.
Figure 4:
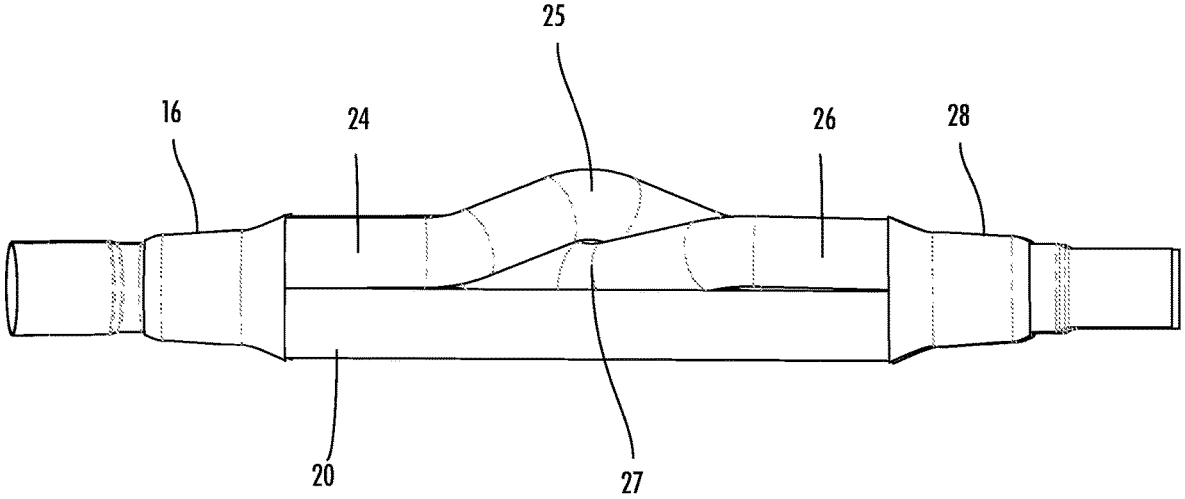
FIG. 4 shows a side view of a cross-pipe exhaust assembly according to one embodiment of the present disclosure.

The first inlet collector 12 is further in fluid communication with a first crossover pipe 24 and the second inlet collector 14 is further in fluid communication with a second crossover pipe 26, as shown in FIG. 2. The first crossover pipe 24 and second crossover pipe 26 are shaped such that the two cross one another between first and second ends of the first crossover pipe 24 and the second crossover pipe 26, as shown in FIG. 2. Referring to FIG. 4, the first crossover pipe 24 preferably includes a bend 25, such as an upward bend, formed at or near a midpoint of the first crossover pipe 24 such that the first crossover pipe 24 crosses over the second crossover pipe 26. The second crossover pipe 26 also preferably includes a bend 27, such as a downward bend, that is located adjacent or proximate to the bend of the first crossover pipe 24, such as at a point where the first crossover pipe 24 intersects with the second crossover pipe 26, such that the first crossover pipe 24 and second crossover pipe 26 are at least partially intertwined or nested as shown in FIG. 4.

A diameter of the first crossover pipe 24, the second crossover pipe 26, the first conduit 20, and the second conduit 22 may vary. A diameter of the first crossover pipe 24, the second crossover pipe 26, the first conduit 20, and the second conduit 22 may be the same. Alternatively, a diameter of the first crossover pipe 24 and the second crossover pipe 26 may be greater than a diameter of the first conduit 20 and the second conduit 22. In another alternative, a diameter of the first conduit 20 and the second conduit 22 may be greater than a diameter of the first crossover pipe 24 and the second crossover pipe 26.

The first inlet collector 12 and the second inlet collector 14 preferably split a flow from a single conduit into at least two conduits, such as into the crossover pipes and inline pipes. The first inlet collector 12 and second inlet collector 14 each preferably split an entering flow into two outlets, such as an upper outlet and a lower outlet from each of the first inlet collector 12 and the second inlet collector 14.

A first outlet collector 28 is located at and in fluid communication with the distal end of the first conduit 20. A second outlet collector 30 is similarly located at and in fluid communication with the distal end of the second conduit 22. The distal end of the first crossover pipe 24 is in fluid communication with the second outlet collector 30, and the distal end of the second crossover pipe 26 is in fluid communication with the first outlet collector 28. A first outlet pipe 32 is in fluid communication with the first outlet collector 28 and a second outlet pipe 34 is in fluid communication with the second outlet collector 30.

The parallel pipes and crossover pipes are preferably in alignment with one another along at least a portion of lengths of the parallel pipes and the crossover pipes such that exhaust flow is gradually diverted through the crossover pipes before recombining with an opposite-side flow. For example, the first conduit 20 and the first crossover pipe 24 preferably extend parallel to one another along a first section of the first crossover pipe 24 such that a direction of flow remains in a parallel direction. When the first crossover pipe 24 joins with the second conduit 22 at the second outlet collector 30, the first crossover pipe 24 and second conduit 22 are preferably aligned such that when the flow through the first crossover pipe 24 joins with the flow through the second conduit 22 the flow is moving in a parallel direction.

Figure 5:
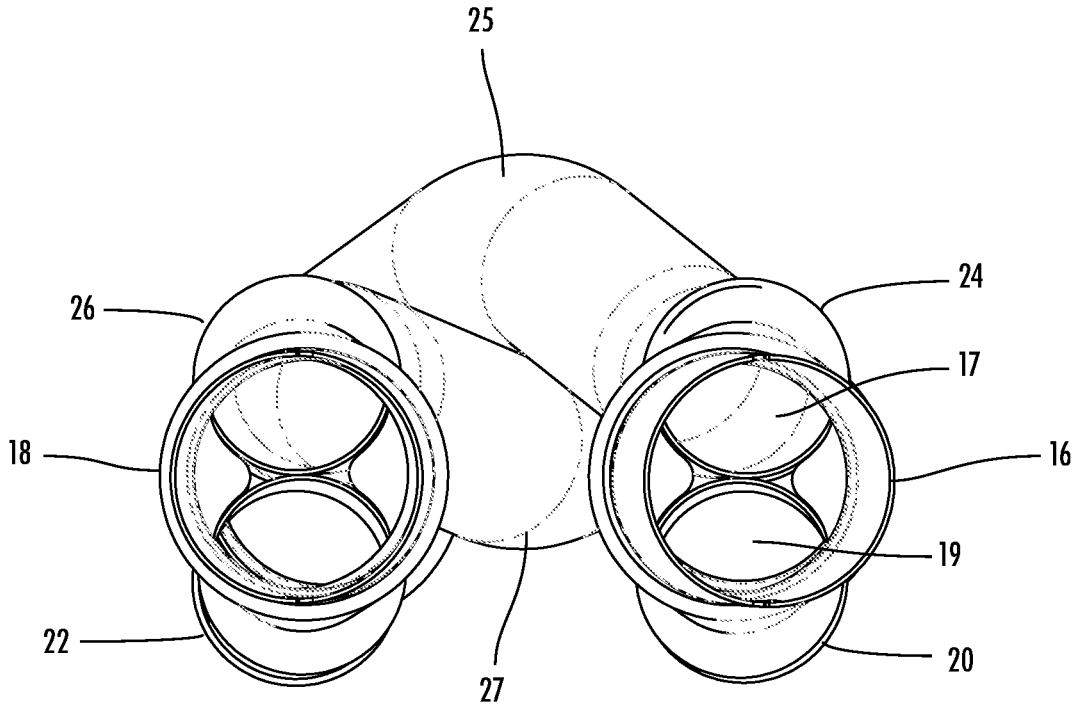
FIGS. 5 and 6 show front and rear views of a cross-pipe assembly system according to one embodiment of the present disclosure.
Figure 6:
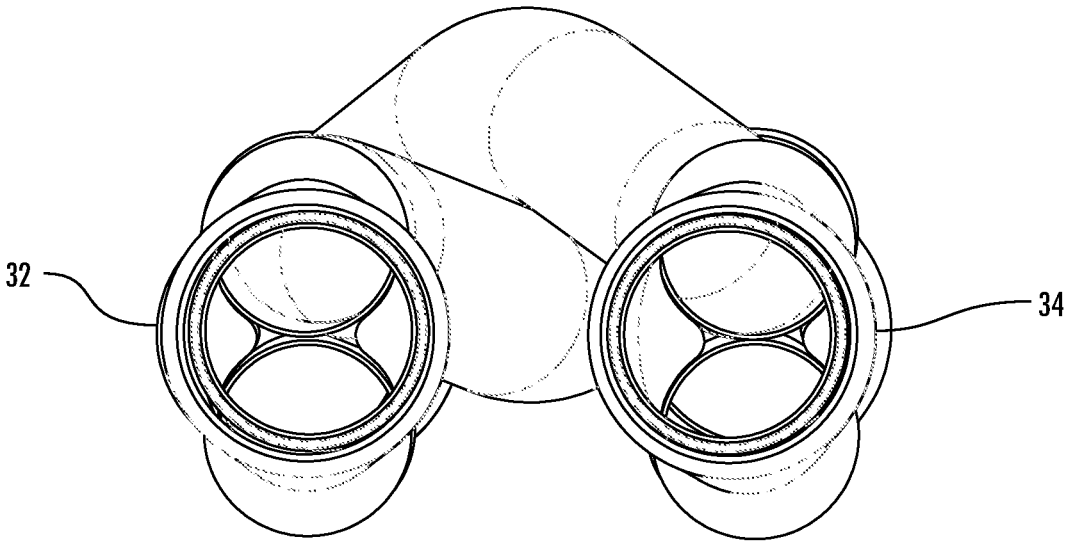

Referring to FIGS. 5 and 6, at least a portion of the parallel pipes and the crossover pipes overlaps with inlets and outlets of the inlet and outlet collectors to further smooth flow through the exhaust assembly 10. When viewed along a length of the exhaust assembly 10, at least a portion of ends of the parallel pipes and crossover pipes overlap with single inlets and single outlets of the inlet and outlet collectors such that a path of flow into the exhaust assembly 10 is minimally disturbed.

In operation, dual flows of exhaust enter the exhaust assembly 10 through the first inlet 12 and second inlet 14. A first flow corresponding to a first bank of cylinders of the engine enters the first inlet 12 and a second flow corresponding to a second bank of cylinders of the engine enters the second inlet 14. When the first and second flows enter the first inlet collector 16 and second inlet collector 18 respectively, a portion of the first flow and the second flow enters the first conduit 20 and second conduit 22 such that the portion of the first flow and second flow travels along a length of the first conduit 20 and second conduit 22 to the first outlet collector 28 and second outlet collector 30. Another portion of the first flow and the second flow enters the first crossover pipe 24 and the second crossover pipe 26. The portions of the first flow and the second flow that enter the first crossover pipe 24 and second crossover pipe 26 are joined with the opposite of the first flow and second flow in the first outlet collector 28 and second outlet collector 30.

Figure 7:
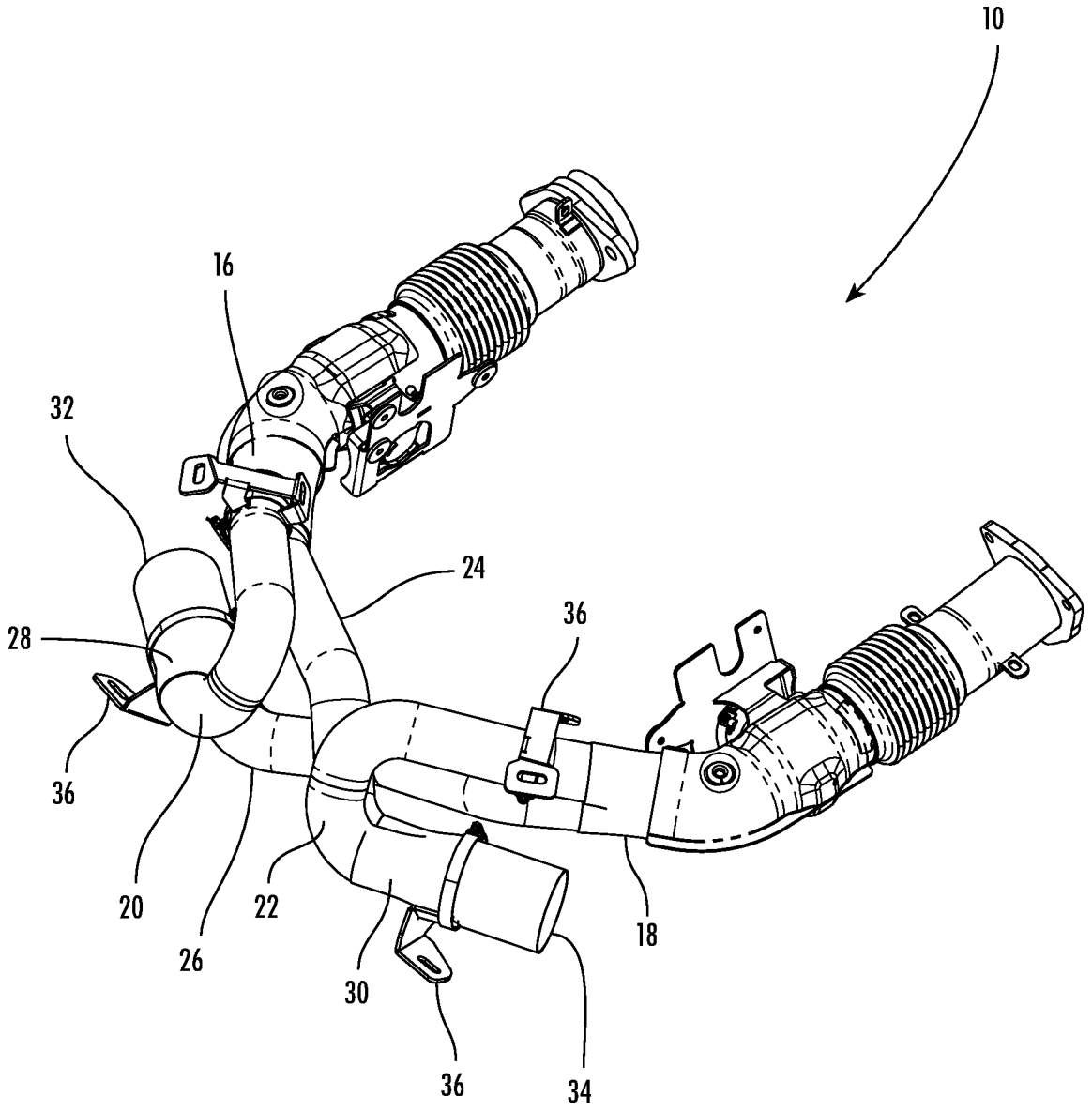
FIG. 7 shows a perspective view of a cross-pipe exhaust assembly according to one embodiment of the present disclosure.

While embodiments herein described include substantially parallel pipes, it is also understood that the arrangement of pipes in the exhaust assembly 10 may vary. For example, and as shown in FIG. 7, each of the parallel pipes and crossover pipes may include one or more bends along lengths of the parallel pipes and crossover pipes. In one embodiment, outlets of the outlet collectors may be offset from inlets of the inlet collectors, such as by about 90 degrees. Other various shapes may be provided along lengths of the parallel pipes and crossover pipes.

Referring to FIG. 7, the exhaust assembly 10 may be arranged in various configurations depending on various factors such as packaging requirements for a vehicle on which the exhaust assembly 10 is installed. The first conduit 20 and the second conduit 22 may include one or more bends. As shown in FIG. 7, the first conduit 20 and the second conduit 22 may include a substantially U-shaped bend. The exhaust assembly 10 as shown in FIG. 7 may allow for installation of the exhaust assembly 10 in a manner that redirects a flow of exhaust into the exhaust assembly 10, such as towards sides of a vehicle rather than along a length of a vehicle. The first inlet collector 16 and the second inlet collector 18 may be oriented such that the first outlet 17 and the second outlet 19 are oriented substantially inward towards a center of a vehicle when the exhaust assembly 10 is mounted thereon. The first outlet collector 28 and the second outlet collector 30 may be oriented such that the first outlet pipe 32 and the second outlet pipe 34 are oriented substantially outward or away relative to a center of a vehicle on which the exhaust assembly 10 is installed. The first conduit 20 and the second conduit 22 may have a U-shaped section to allow the first conduit 20 and the second conduit 22 to be in fluid communication with the first outlet collector 28 and the second outlet collector 30 respectively when arranged as described herein and as shown in FIG. 7.

The exhaust assembly 10 may further include one or more brackets 36 for securing the exhaust assembly 10 to a vehicle. The one or more brackets 36 may be located on one or more of the first inlet collector 16, the second inlet collector 18, the first conduit 20, the second conduit 22, the first crossover pipe 24, the second crossover pipe 26, the first outlet collector 28, and the second outlet collector 30. The one or more brackets 36 may be clamped onto one or more portions of the exhaust assembly 10 and may be located such that the one or more brackets 36 support the exhaust assembly 10 on a vehicle.

The exhaust assembly 10 of the present disclosure advantageously provides an exhaust assembly that allows for equalization of pressure in exhaust flow from an internal combustion engine. The exhaust assembly 10 may further improve a sound of the internal combustion engine. Shapes of pipes of the exhaust assembly 10 further reduce an amount of space required to install the exhaust assembly 10 on a vehicle, and also create a distinctive appearance.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. An exhaust assembly for exhausting gas from an internal combustion engine, the exhaust assembly comprising:

a first upstream conduit in fluid communication with a first bank of cylinders of an internal combustion engine;

a second upstream conduit in fluid communication with a second bank of cylinders of the internal combustion engine;

a first inlet collector connected to an end of the first upstream conduit, the first inlet collector having an inlet and splitting into first outlet and a second outlet, wherein the first outlet and the second outlet of the first inlet collector are aligned with the inlet;

a second inlet collector connected to an end of the second upstream conduit, the second inlet collector splitting into a first outlet and a second outlet;

a first outlet collector located downstream of the first inlet collector, the first outlet collector joining a first inlet and a second inlet into a single outlet of the first outlet collector;

a second outlet collector located downstream of the second outlet collector, the second outlet collector joining a first inlet and a second inlet into a single outlet of the second outlet collector;

a first conduit in fluid communication with one of the first outlet and the second outlet of the first inlet collector and one of the first inlet and the second inlet of the first outlet collector, the first conduit having at least one bend formed along a length of the first conduit;

a second conduit in fluid communication with one of the first outlet and the second outlet of the second inlet collector and one of the first inlet and the second inlet of the second outlet collector, the second conduit having at least one bend formed along a length of the second conduit;

a first crossover pipe in fluid communication one of the first outlet and the second outlet of the first inlet collector and one of the first inlet and the second inlet of the second outlet collector; and a second crossover pipe in fluid communication with one of the first outlet and the second outlet of the second inlet collector and one of the first inlet and the second inlet of the first outlet collector.

2. The exhaust assembly of claim 1, wherein the at least one bend of the first conduit and the second conduit is U-shaped.

3. The exhaust assembly of claim 1, further comprising one or more brackets located on one of the first conduit, the second conduit, the first crossover pipe, and the second crossover pipe for supporting the exhaust assembly on a vehicle.

4. The exhaust assembly of claim 1, wherein:

the first inlet collector and the second inlet collector are oriented such that the first outlet and the second outlet are oriented inward towards a center of a vehicle on which the exhaust assembly is installed; and the first outlet collector and the second outlet collector are oriented such that the single outlet of the first outlet collector and the single outlet of the second outlet collector are oriented outward away from the center of the vehicle on which the exhaust assembly is installed.

5. The exhaust assembly of claim 1, further comprising:

a bend located along a length of the first crossover pipe; and a bend located along a length of the second crossover pipe;

wherein the bend located along the length of the second crossover pipe is located proximate to a point at which the first crossover pipe intersects with the second crossover pipe such that the first crossover pipe and the second crossover pipe are at least partially intertwined.

6. The exhaust assembly of claim 1, wherein a diameter of the first conduit is greater than a diameter of the first crossover pipe and wherein a diameter of the second conduit is greater than a diameter of the second crossover pipe.

7. An exhaust assembly for exhausting gas from an internal combustion engine, the exhaust assembly comprising:

a first upstream conduit in fluid communication with a first bank of cylinders of an internal combustion engine;

a second upstream conduit in fluid communication with a second bank of cylinders of the internal combustion engine;

a first inlet collector connected to an end of the first upstream conduit, the first inlet collector having an inlet and splitting into first outlet and a second outlet, wherein the first outlet and the second outlet of the first inlet collector are aligned with the inlet;

a second inlet collector connected to an end of the second upstream conduit, the second inlet collector splitting into a first outlet and a second outlet;

a first outlet collector located downstream of the first inlet collector, the first outlet collector joining a first inlet and a second inlet into a single outlet of the first outlet collector;

a second outlet collector located downstream of the second outlet collector, the second outlet collector joining a first inlet and a second inlet into a single outlet of the second outlet collector;

a first conduit in fluid communication with one of the first outlet and the second outlet of the first inlet collector and one of the first inlet and the second inlet of the first outlet collector;

a second conduit in fluid communication with one of the first outlet and the second outlet of the second inlet collector and one of the first inlet and the second inlet of the second outlet collector;

a first crossover conduit in fluid communication with one of the first outlet and the second outlet of the first inlet collector and one of the first inlet and the second inlet of the second outlet collector, the first crossover conduit having at least one bend formed along a length of the first crossover conduit; and a second crossover conduit in fluid communication with one of the first outlet and the second outlet of the second inlet collector and one of the first inlet and the second inlet of the first outlet collector, the second crossover conduit having at least one bend formed along a length of the second crossover conduit;

wherein the at least one bend formed along a length of the first crossover conduit is proximate to the at least one bend formed along the length of the second crossover conduit such that the first crossover conduit and the second crossover conduit are at least partially intertwined, wherein the first inlet collector is configured such that a first section of the first conduit adjacent the first inlet collector is parallel with a first section of the first crossover pipe adjacent the first inlet collector, and wherein the second inlet collector is configured such that a first section of the second conduit adjacent the second inlet collector is parallel with a first section of the second crossover pipe adjacent the second inlet collector.

8. The exhaust assembly of claim 7, further comprising:

a bend located along a length of the first conduit; and a bend located along a length of the second conduit.

9. The exhaust assembly of claim 8, wherein the bend located along the length of the first conduit and the bend located along the length of the second conduit are U-shaped.

10. The exhaust assembly of claim 9, wherein:

the first inlet collector and the second inlet collector are oriented such that the first outlet and the second outlet are oriented inward towards a center of a vehicle on which the exhaust assembly is installed; and the first outlet collector and the second outlet collector are oriented such that the single outlet of the first outlet collector and the single outlet of the second outlet collector are oriented outward away from the center of the vehicle on which the exhaust assembly is installed.

11. An exhaust assembly for exhausting gas from an internal combustion engine, the exhaust assembly comprising:

a first upstream conduit in fluid communication with a first bank of cylinders of an internal combustion engine;

a second upstream conduit in fluid communication with a second bank of cylinders of the internal combustion engine;

a first inlet collector connected to an end of the first upstream conduit, the first inlet collector having an inlet and splitting into first outlet and a second outlet, wherein the first outlet and the second outlet of the first inlet collector are aligned with the inlet;

a second inlet collector connected to an end of the second upstream conduit, the second inlet collector splitting into a first outlet and a second outlet;

a first outlet collector located downstream of the first inlet collector, the first outlet collector joining a first inlet and a second inlet into a single outlet of the first outlet collector;

a second outlet collector located downstream of the second outlet collector, the second outlet collector joining a first inlet and a second inlet into a single outlet of the second outlet collector;

a first conduit in fluid communication with one of the first outlet and the second outlet of the first inlet collector and one of the first inlet and the second inlet of the first outlet collector, the first conduit including a U-shaped bend formed along a length thereof;

a second conduit in fluid communication with one of the first outlet and the second outlet of the second inlet collector and one of the first inlet and the second inlet of the second outlet collector, the second conduit including a U-shaped bend formed along a length thereof;

a first crossover conduit in fluid communication one of the first outlet and the second outlet of the first inlet collector and one of the first inlet and the second inlet of the second outlet collector, the first crossover conduit having at least one bend formed along a length of the first crossover conduit; and a second crossover conduit in fluid communication with one of the first outlet and the second outlet of the second inlet collector and one of the first inlet and the second inlet of the first outlet collector, the second crossover conduit having at least one bend formed along a length of the second crossover conduit;

wherein the at least one bend formed along a length of the first crossover conduit is proximate to the at least one bend formed along the length of the second crossover conduit such that the first crossover conduit and the second crossover conduit are at least partially intertwined.

12. The exhaust assembly of claim 11, wherein:

the first inlet collector and the second inlet collector are oriented such that the first outlet and the second outlet are oriented inward towards a center of a vehicle on which the exhaust assembly is installed; and the first outlet collector and the second outlet collector are oriented such that the single outlet of the first outlet collector and the single outlet of the second outlet collector are oriented outward away from the center of the vehicle on which the exhaust assembly is installed.

* * * * *